United States Patent [19]

Sampsel

[11] 4,143,646

[45] Mar. 13, 1979

[54] COOKING APPARATUS AND EXHAUST SYSTEM

[75] Inventor: Kenneth E. Sampsel, Dallas, Tex.

[73] Assignee: Home Metal Products Company a Division of Mobex Corporation, Plano, Tex.

[21] Appl. No.: 846,169

[22] Filed: Oct. 27, 1977

[51] Int. Cl.[2] ..... F24C 15/20

[52] U.S. Cl. ..... 126/299 D

[58] Field of Search ..... 126/299 R, 299 D, 303; 98/115

[56] References Cited

U.S. PATENT DOCUMENTS

| | | | |
|---|---|---|---|
| Re. 27,225 | 11/1971 | Stalker | 55/470 |
| 1,584,707 | 5/1926 | Hedeen | 126/299 R |
| 2,392,038 | 1/1946 | Gaylord | 126/299 D |
| 3,064,551 | 11/1962 | Stalker | 98/115 |
| 3,249,037 | 5/1966 | Stalker | 98/115 |
| 3,251,290 | 5/1966 | Jenson et al. | 126/299 D |
| 3,362,319 | 1/1968 | Wallace | 98/115 |
| 3,372,632 | 3/1968 | Stalker | 98/115 |
| 3,387,437 | 6/1968 | Stalker | 55/470 |
| 3,538,839 | 11/1970 | Stalker | 98/115 |
| 3,695,164 | 10/1972 | Stalker | 98/115 K |

*Primary Examiner*—Edward G. Favors

*Attorney, Agent, or Firm*—Richards, Harris & Medlock

[57] ABSTRACT

An improved cooking apparatus and exhaust system includes an eye-level oven mounted over a stove top and a filtered duct system for receiving gases in the vicinity of the stove top and the front of the eye-level oven and for discharging these gases through one of three discharge ports including a ductless discharge port.

13 Claims, 5 Drawing Figures

COOKING APPARATUS AND EXHAUST SYSTEM

BACKGROUND AND SUMMARY OF THE INVENTION

The present invention relates to an improved exhaust system and cooking apparatus, specifically to an eye-level oven having an exhaust system intake in its bottom wall positioned generally above a stove.

In previous cooking apparatus having an eye-level oven mounted generally above a stove top, an exhaust hood has been provided on the top of the eye-level oven. Gases and cooking fumes in the stove top vicinity had to travel up past the front of the eye-level oven and into the intake of the hood which was usually mounted near the front top surface of the eye-level oven. Such exhaust systems have proven to be less than wholly satisfactory for a number of reasons. For example, since the cooking fumes had to travel a considerable distance to the intake of the exhaust hood, the fumes tended to dissipate throughout the entire room rather than entering the exhaust hood. Also, the airflow from the stove top to the hood was generally directed into the face of a cook producing discomfort and inconvenience. Furthermore, the fumes from the stove top tended to deposit grease, carbon, and the like on the bottom and front walls of the eye-level oven. In many ovens gases emanating from the stove top could escape around the sides of the eye-level oven avoiding the intake of the exhaust hood.

The present cooking apparatus and exhaust system provides an additional exhaust system intake which is located in the bottom wall of the eye-level oven. Thus, the primary intake of the exhaust system is located directly above the stove top and is therefore positioned for receiving gases, fumes and the like emanating from food cooking on the stove top. This additional intake mounted in close proximity to the source of most cooking fumes greatly increases the efficiency and effectiveness of the exhaust system. Furthermore, this additional intake port is incorporated into an exhaust system which includes an intake port mounted on the top front surface of the eye-level oven.

In accordance with an aspect of the present invention, a cooking apparatus is provided with a stove and an eye-level oven mounted generally above the stove top. A filter is mounted in an intake port located on the bottom surface of the eye-level oven. The filter receives air and gases from the vicinity of the stove top and directs these gases through a duct system extending rearwardly along the bottom of the oven and then upwardly along the back of the oven to an exhaust hood which is mounted on top of the oven. A fan mounted in the exhaust hood pulls air through the aforementioned filter and duct system and discharges the air through at least one of three discharge ports.

In accordance with another aspect of the present invention, an exhaust hood mounted on the top of an eye-level oven includes an intake port on the front surface of the hood near the face of the eye-level oven for receiving air and gases into the exhaust hood, the gases then being exhausted through at least one of three discharge ports.

In accordance with another aspect of this invention the exhaust hood mounted on the top of the eye-level oven includes an intake chamber and an exhaust chamber with a fan port connecting the two chambers. A fan is positioned within the fan port such that the fan creates low pressure in the intake chamber and a high pressure in the exhaust chamber relative to atmospheric pressure. The fan is switched into an "off" and "on" condition and into various angular velocities by a switch electrically connected to the fan and mounted on the front surface of the exhaust hood. The low pressure draws gases including air into the intake chamber from intake ports. The gases drawn into the intake chamber are forced into the exhaust chamber and exhausted through one of three discharge ports. Also provided is a pivotally mounted cover means for selectively covering the front intake port and the front surface of the exhaust hood. The cover includes a hole for providing access to the aforementioned switch when the cover is in a closed position.

In accordance with another aspect of the present invention, an exhaust hood includes a ductless discharge port for discharging filtered air which was drawn from the cooking area back into the exterior area around the cooking apparatus. The exhaust hood further includes a top discharge port and a rear discharge port for connection to duct systems which direct the air collected from the cooking vicinity to a remote discharge area. Plates are provided to selectively cover discharge ports which are not to be used.

In accordance with another aspect of this invention the exhaust hood includes an isolated chamber that is positioned over exhaust vents in the eye-level oven. Gases exhausting from the oven enter the isolated chamber and are exhausted through discharge ports in the top surface of the third chamber.

DESCRIPTION OF THE DRAWINGS

For a more complete understanding of the invention and for further objects and advantages thereof, reference is now made to the accompanying drawings, in which.

DESCRIPTION OF THE PREFERRED EMBODIMENT

Figure 1:
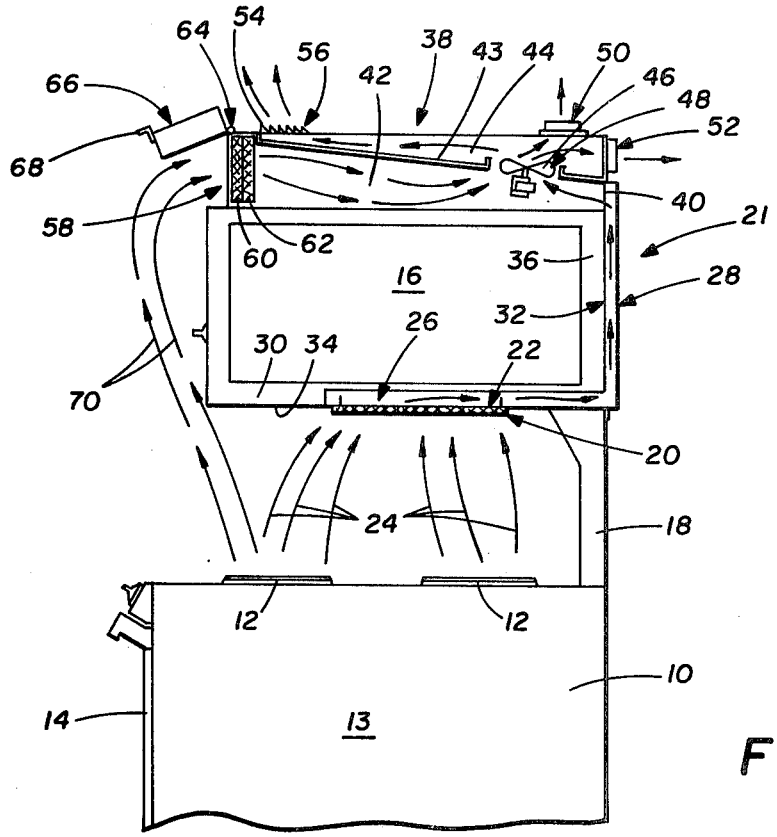
FIG. 1 is a partially cross-sectional view of one side of a stove with an eye-level oven and an exhaust hood showing airflow patterns.

Referring now to the drawings, and particularly to FIG. 1, there is shown a cooking range 10 incorporating the invention. The cooking range 10 is provided including burners 12 of which two are shown. The range also includes a lower oven 13 beneath the burners 12. Access is gained to the lower oven 13 through the oven door 14. An eye-level microwave oven 16 is supported above the burners 12 by support arm 18. Microwave oven 16 is positioned high enough above the burners 12 to allow easy access to the burners 12, but low enough to allow easy access to the microwave oven 16 and to allow efficient exhausting of cooking fumes emanating from food in the vicinity of burners 12.

A filter 20 is positioned on the lower surface of oven 16 directly above the burners 12. Filter 20 is mounted over intake port 22 of an exhaust system 21. The air and cooking fumes in the vicinity of burners 12 are at least partially drawn into the exhaust system 21 through filter 20 as shown by airflow lines 24. These gases drawn through filter 20 and intake port 22 are directed rearwardly through a horizontal duct 26 extending along the bottom of oven 16. The gases are then directed upwardly through a rear vertical duct 28 located behind oven 16. In the preferred embodiment the horizontal duct 26 is a cavity within the bottom wall 30 of oven 16 and the vertical rear duct 28 is mounted on the rear wall 32 of oven 16. It should, however, be noted that the horizontal duct 26 including the filter 20 and the intake port 22 could be mounted on the bottom surface 34 of oven 16, and the vertical rear duct 28 could be mounted within the rear wall cavity 36 of oven 16.

Gases are received from rear duct 28 into hood 38 through intake port 40. The gases enter intake chamber 42 and are forced into discharge chamber 44 by fan 46 through fan port 48. The fan 46 creates low pressure in intake chamber 42 and high pressure in discharge chamber 44 relative to atmospheric pressure. This low pressure in chamber 42 creates a vacuum effect at intake 22 causing air to be drawn into the exhaust system. The high pressure area in discharge chamber 44 causes the gases to be exhausted out of either top discharge 50, rear discharge 52 or ductless discharge 54. The ductless discharge port 54 includes vents 56 to direct the flow direction of the exhausted gases. Removable cover plates may also be provided for selectively covering any or all of the three discharge ports 50, 52 and 54 according to the user's wishes.

A second intake port 58 is provided on the front of hood 38 for receiving air and gases in the vicinity of the front of microwave oven 16. Filters 60 and 62 are mounted inside intake port 58 to filter air and gases received into intake chamber 42. Hinges 64 are mounted on hood 38 at the intersection of the horizontal top surface and the vertical front surface of hood 38. One such hinge 64 is shown. Hinged cover 66 is pivotally mounted by hinges 64 and positioned to selectively cover intake port 58. Handle 68 is mounted on cover 66 to facilitate opening of cover 66 and a curved plate is provided to support cover 66 in an open horizontal position. The intake port 58 receives air from the vicinity of the oven door by virtue of the vacuum effect created by intake chamber 42. The suction by intake port 58 results in an airflow pattern illustrated by airflow lines 70 extending from the vicinity of cooking burners 12 towards intake port 58. In this manner intake port 58 also serves to exhaust gases including air from the vicinity of the burners 12.

Although the preferred embodiment of the invention uses the described exhaust hood, it is understood that the exhaust system could be constructed without a hood. In this embodiment the front intake port 58 would be eliminated and the fan 46 would be mounted either in port 22, or in the adjoining ducts 26 and 28 or in a chamber connected to duct 26 or 28.

Figure 2:
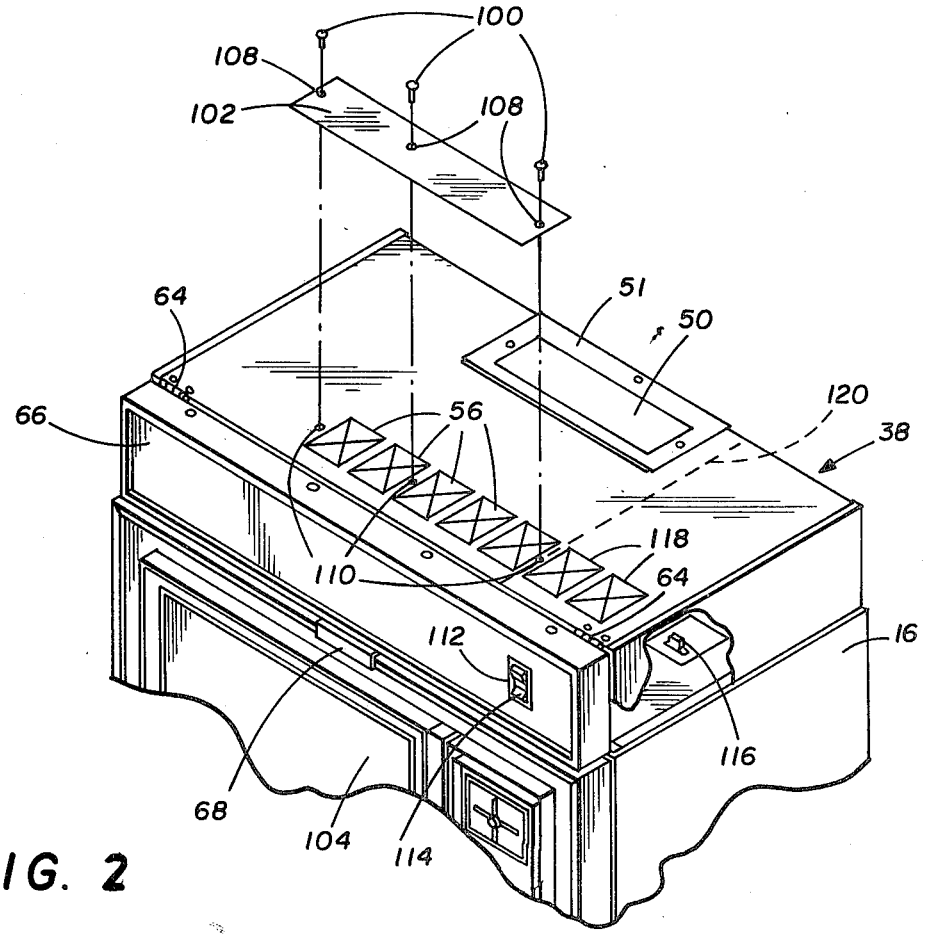
FIG. 2 is a top view of the exhaust hood mounted on an eye-level oven showing an exploded view of the plate used to cover the ductless discharge port.

Referring to FIG. 2, a top view of hood 38 and eye-level oven 16 is shown. An exploded view of plate 102 is shown above its position on hood 38 covering ductless discharge port 54. When it is not desired to discharge air through ports 54, the plate 102 is securely fastened over port 54 by screws 100 which pass through holes 108 and thread into holes 110. The plate 102 in position serves to block air from passing out of ductless discharge port 54.

Cover 66 is supported by hinges 64 and is shown in a closed position over intake port 58. A hole 112 exposes switch 114 which is mounted on the front surface of hood 38. An electrical terminal 116 is mounted within hood 38 and is used for making electrical connections between hood 38 and microwave oven 16. A top discharge port 50 is shown on the top surface of hood 38 centered laterally with respect to the hood and positioned generally on the rear portion of the top surface of hood 38. Discharge port 50 is defined by frame 51 of which a portion is shown. An additional discharge port 118 is provided on the top surface of hood 38 which serves to discharge gases escaping from microwave oven 16 and passing into hood 38. Hood 38 contains a panel in a vertical position mounted along the dotted line 120. This panel serves to separate gases escaping into the hood from microwave oven 16 from the gases drawn into the hood through intake ports 58 and 22. The microwave oven door 104 may be freely opened and closed without interference from any part of the exhaust system.

Figure 3:
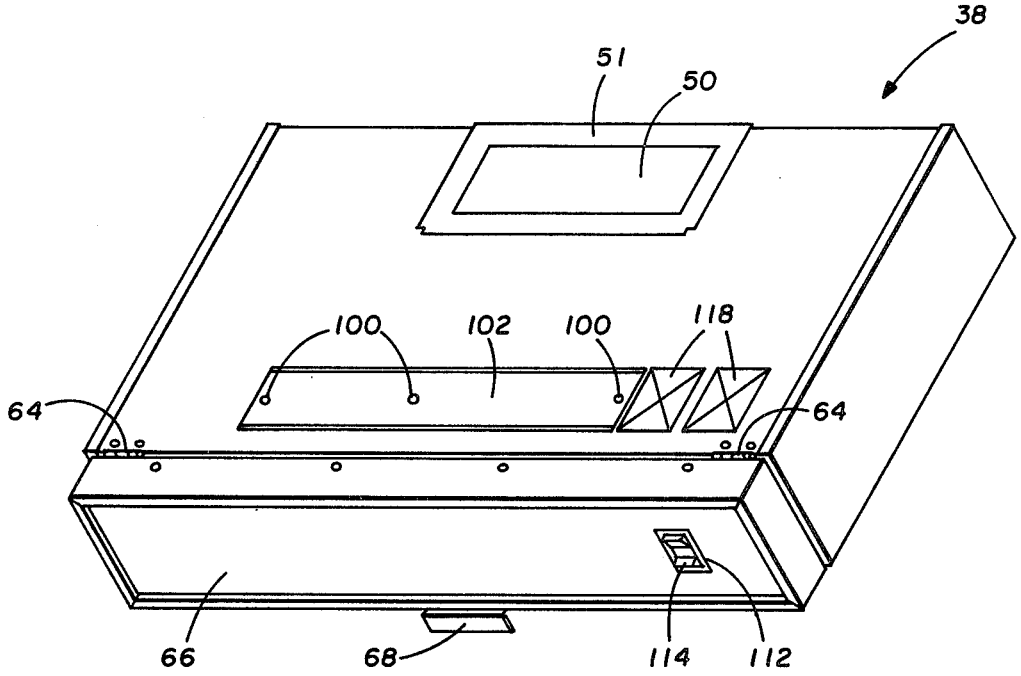
FIG. 3 is a top view of the exhaust hood showing a plate covering the ductless discharge port and showing a pivotal cover in a closed position over the front intake port.

FIG. 3 shows another top view of the hood. Plate 102 is in position on the ductless discharge port 54 to block air from discharging out vents 56. Plate 102 is secured in position by means of screws 100.

Figure 4:
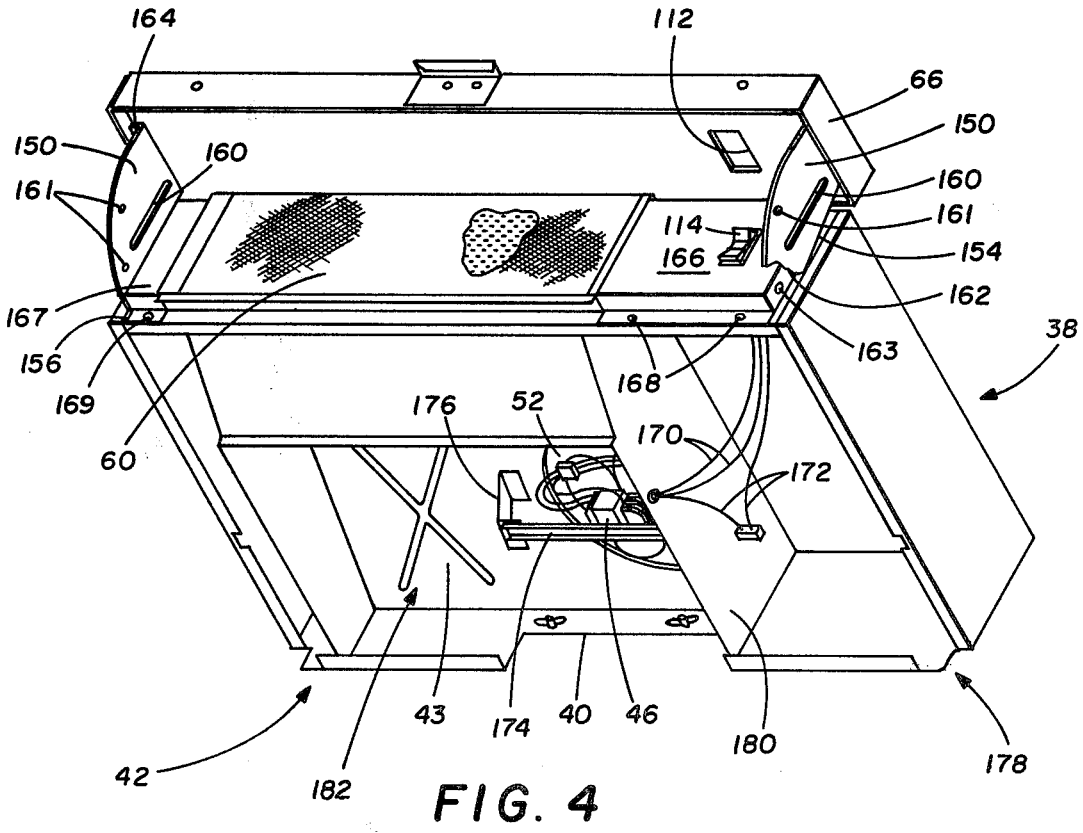
FIG. 4 is a pictorial bottom view of the exhaust hood showing the front intake port in an open position.

FIG. 4 shows a bottom view of the hood 38. Cover 66 supported by plates 150 is in an open position exposing filter 60. Plate 166 and plate 167 are secured on hood 38 overlapping and securing filter 60 in position over intake port 58. Slots 154 and 156 in hood 38 are adapted to receive curved plates 150 when cover 66 is in a closed position. Ribs 160 are impressed in plates 150 to provide increased strength. Plates 150 are mounted by flanges 164 which are spot welded to cover 66. Indents 161 frictionally engage catches 163 and support plates 150 in two stable positions. Hooks 204 (best shown in FIG. 5) on plates 150 prevent the cover 66 from rotating open more than ninety (90) degrees.

Switch 114 is mounted in plate 166 which is secured on the front surface of hood 38 by means of screws 168 of which two are shown. Hole 112 is positioned on cover 66 to allow access to switch 114 when in a closed position. Switch 114 is connected to fan 46 of which a portion is shown by means of wires 170 and wires 172. The switch may be used to switch the fan into an "on" and an "off" condition or with variable speed fans, a multiposition switch may be used to switch the fan into an "off" condition and into a number of different speeds.

Fan 46 is mounted on bar 174 which is in turn mounted on flanges 176 of which one is shown. Flanges 176 are spot welded on the intake chamber side of inclined panel 43 such that the fan is primarily mounted inside intake chamber 42 and forces gases through exhaust port 52 into the discharge chamber 44 (not shown). An indention 182 in the form of an "X" increases the resistance of panel 43 to warping and bending pressures.

Additionally shown in FIG. 4 is an isolated chamber 178 defined by the right side of hood 38 as viewed in FIG. 4 and vertical panel 180. Chamber 178 functions to receive gases from the microwave oven 16 and to exhaust them into the surrounding atmosphere through ports 118 shown in FIG. 3. In the preferred embodiment wires 170 and 172 are contained in chamber 178 because of the relatively low volume of gases passing through chamber 178.

Figure 5:
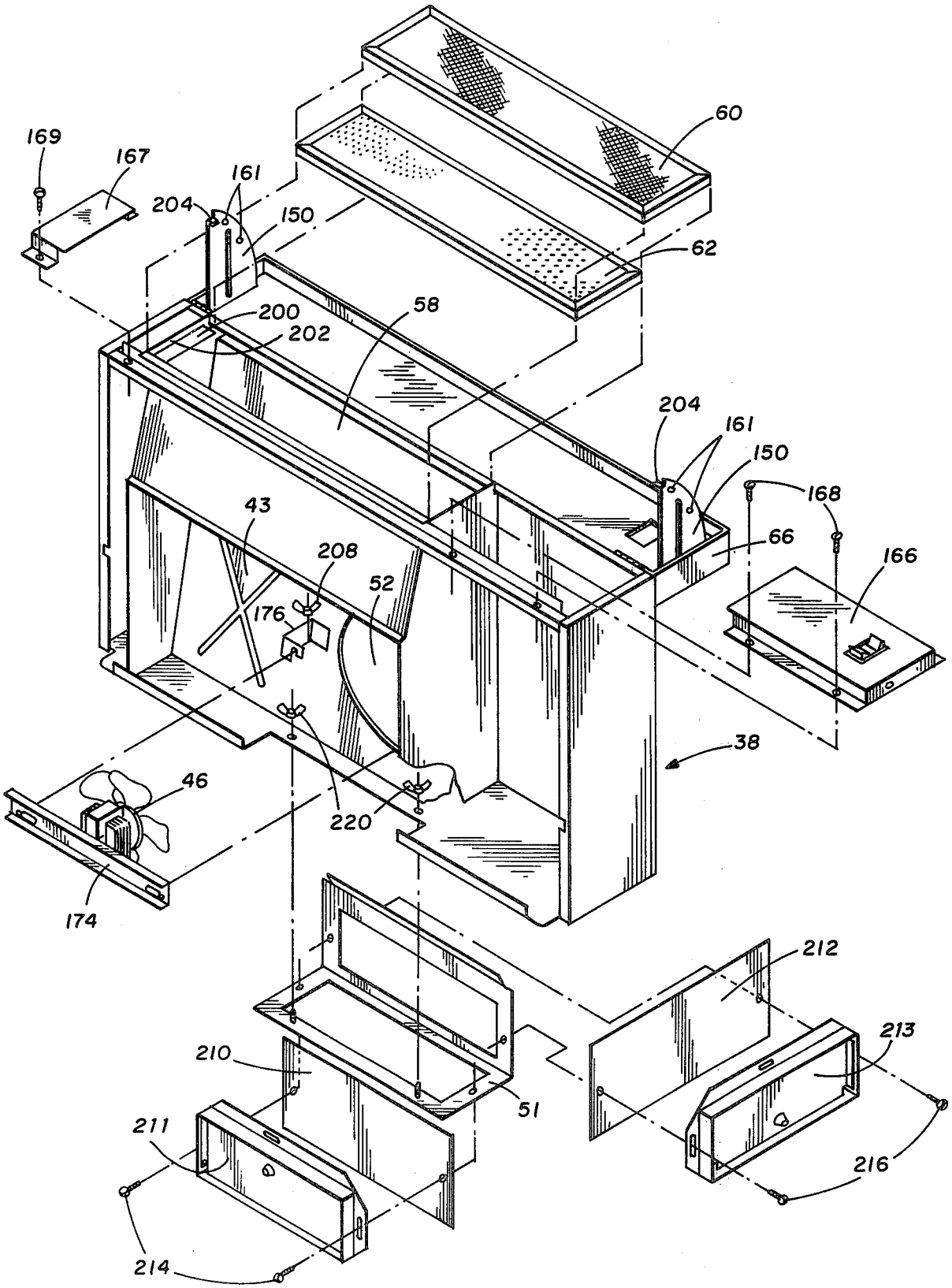
FIG. 5 is an exploded bottom view of the exhaust hood.

FIG. 5 shows an exploded view of the hood which may be examined to further illustrate the construction of hood 38. Filter 60 is mounted in front of filter 62 and both are positioned over intake port 58 and are supported by flanges 200 and 202. Plates 166 and 167 are mounted on hood 38 by means of screws 168 and 169 respectively and serve to secure filters 60 and 62 in position on the front of hood 38. In this view stops 204 on plates 150 respectively are shown. Stops 204 engage the inner surfaces of slots 154 and 156 and prevent cover 66 from rotating open more than ninety (90) degrees with respect to the front surface of hood 38. In this exploded view the fan 46 is shown mounted on bar 174 and positioned to be secured on L-flanges 176 by means of bolts and wing nuts 208. Also clearly shown in this view is the exhaust port 52 which is a hole in inclined panel 43.

Frame 51 is clearly shown in a position to be mounted on the top side of hood 38 and thereby define both the top discharge port 50 and the rear discharge port 52. Plates 210 and 212 are removably mounted in frame 51 by interlocking tabs. Plates 210 and 212 may be removed to open their respective discharge ports as desired. Plates 210 and 212 may be used to block their respective discharge ports as desired when other discharge ports are being utilized. Baffles 211 and 213 are removably mounted on frame 51 by screws 214 and 216 respectively. Baffles 211 and 213 are used when it is desired to use top discharge port 50 or rear discharge port 52. The baffles 211 and 213 are molded to receive a duct system and function to allow gases out but not into exhaust chamber 44. In the preferred embodiment the frame 51 is secured on hood 38 by means of wing nuts 200 of which two are shown.

Having thus fully disclosed the present invention with regard to certain specific embodiments, certain changes and modifications will suggest themselves to those skilled in the art, and it is intended that such modifications be covered as within the scope of the appended claims.

What is claimed is:

1. A cooking apparatus and exhaust system comprising:

a stove top including at least one burner, an eye-level oven, means for supporting the eye-level oven above the stove top, inlet port means mounted on the bottom of the eye-level oven above the stove top, horizontal duct means extending from the inlet port means rearwardly along the bottom of the eye-level oven, vertical duct means connected at one end to receive gases from the horizontal duct means and extending along the rear wall of the eye-level oven, housing means mounted on the top of the eye-level oven and having an intake port and at least one discharge port, said intake port being connected to receive gases from the vertical duct means, and means for drawing gases from the region between the stove top and the eye-level oven into the inlet port means, through horizontal and vertical duct means and through the intake port of the housing, and for forcing said gases out the discharge port of the housing.

2. The cooking apparatus and exhaust system as defined in claim 1 wherein said housing means comprises a hood detachably mounted on top of the eye-level oven.

3. The cooking apparatus and exhaust system as defined in claim 2 further comprising:

a panel for separating the hood into an intake chamber and a discharge chamber, said intake chamber having at least one intake port connected to receive gases from the vertical duct means, said panel having fan port means for allowing gases to pass from the intake chamber to the discharge chamber, fan means mounted adjacent the fan port means to force gases from the intake chamber into the discharge chamber, and said discharge chamber having a top discharge port, a rear discharge port and a ductless discharge port for exhausting gases out of the discharge chamber.

4. The cooking apparatus and exhaust system as defined in claim 3 further comprising:

a first plate for covering the ductless discharge port, means for removably securing the first plate over the ductless discharge port, a second plate for covering the top discharge hole, means for removably securing the second plate over the top discharge port, a third plate for covering the rear discharge hole, and means for removably securing the third plate over the rear discharge hole.

5. The cooking apparatus and exhaust system of claim 3 further comprising:

vents for directing gasflow, and means for mounting said vents in the ductless discharge port.

6. The cooking apparatus and exhaust system as defined in claim 2 further including:

a front intake port for receiving gases from the vicinity of the front of the eye-level oven, air filter means for filtering gases entering the front intake port, and means for mounting the filter within the front intake port.

7. The cooking apparatus and exhaust system of claim 6 further comprising:

hinges attached to the hood, a hinged cover pivotally supported by the hinges to selectively block the front intake hole, and means for supporting said cover in an open position.

8. The cooking apparatus and exhaust system as defined in claim 7 wherein said support means comprises:

at least one curved plate attached to the hinged cover for supporting said cover in an open position, indents in the plate for supporting the plate in several open positions, and a catch on the front surface of said hood for engaging and supporting the indent.

9. The cooking apparatus and exhaust system as defined in claim 2 wherein:

the eye-level oven has vents for exhausting gases, a panel is positioned within the hood to form an isolated chamber, said isolated chamber being positioned over the oven vents to receive gases emanating therefrom, and said hood has at least one port for exhausting gases from the isolated chamber.

10. The cooking apparatus and exhaust system as defined in claim 3 further comprising:

a switch for selectively switching the fan means "on" and "off" and for selectively varying the speed of said fan, means for mounting the switch on an exterior surface of the hood, and means for electrically connecting the switch to the fan.

11. The cooking apparatus and exhaust system as defined in claim 1 wherein the means comprises:

the bottom wall of the eye-level oven having a cavity formed therein extending from the front towards the rear of the oven, said cavity extending to a port comprising the inlet port means, filter means mounted in the port of the cavity, and means for connecting the duct at one end to receive gases from the cavity.

12. A cooking apparatus and exhaust system comprising:

a stove with one or more burners located on the stove top, an eye-level oven having exhaust vents for allowing gases to escape from the oven, said oven also including a bottom wall having a cavity formed therein extending from the rear towards the front of the oven, means for supporting the oven generally above said stove top, the bottom surface of said oven having an inlet port exposing the cavity for receiving gases from the vicinity of the stove top, a filter for covering the inlet port, means for supporting the first filter in a position over the inlet port, a vertical duct disposed along the rear of the eye-level oven connected at one end to receive gases from the cavity and to direct said gases towards the top of the eye-level oven, a hood positioned on the top of said eye-level oven, said hood including a front surface, a rear surface, two side surfaces and a top surface, and having an intake chamber, a discharge chamber, and an isolated chamber, an inclined panel positioned within said hood defining the boundary between said intake chamber and said discharge chamber, said panel having a fan port for transmitting gases from the intake chamber into the discharge chamber, said intake chamber having a rear intake port, said rear intake port connected to receive gases from the vertical duct into the intake chamber, an electric fan or blower mounted adjacent the fan port to force gases out of the intake chamber into the exhaust chamber, said discharge chamber having a top discharge port, a rear discharge port, and a ductless discharge port for transmitting gases out of the discharge chamber, vents for controlling the direction of gas flow, means for mounting said vents within the ductless discharge port, first removable means for covering the ductless discharge port to selectively block gases from flowing through said ductless discharge port, second removable means for covering the top discharge port to selectively block gases from flowing through said top discharge port, third removable means for covering the rear discharge port to selectively block gases from flowing through said rear discharge port, a vertical panel positioned inside the hood defining the boundary between the isolated chamber and the intake and exhaust chambers, said isolated chamber being positioned over the oven exhaust vents to receive gases from the oven, said hood having isolated discharge port for transmitting gases out of the isolated chamber, and switch means for controlling the flow of electric current to the fan or blower.

13. A cooking apparatus and exhaust system comprising:

a stove with one or more burners located on the stove top, an eye-level microwave oven having exhaust vents for allowing gases to escape from the oven, said oven also including a bottom wall having a cavity formed therein extending from the rear towards the front of the oven, means for supporting the oven generally above said stove top, the bottom surface of said oven having an inlet port exposing the cavity for receiving gases from the vicinity of the stove top, a filter for covering the inlet port, means for supporting the first filter in a position over the inlet port, a vertical duct disposed along the rear of the eye-level oven connected at one end to receive gases from the cavity and to direct said gases towards the top of the eye-level oven, a hood positioned on the top of said eye-level oven, said hood including a front surface, a rear surface, two side surfaces and a top surface, and having an intake chamber, a discharge chamber, and an isolated chamber, an inclined panel positioned within said hood defining the boundary between said intake chamber and said discharge chamber, said panel having a fan port for transmitting gases from the intake chamber into the discharge chamber, said intake chamber having a rear intake port and a front intake port, said rear intake port connected to receive gases from the vertical duct into the intake chamber, an electric fan or blower mounted adjacent the fan port to force gases out of the intake chamber into the exhaust chamber, said discharge chamber having a top discharge port, a rear discharge port, and a ductless discharge port for transmitting gases out of the discharge chamber, vents for controlling the direction of gasflow, means for mounting said vents within the ductless discharge port, first removable means for covering the ductless discharge port to selectively block gases from flowing through said ductless discharge port, second removable means for covering the top discharge port to selectively block gases from flowing through said top discharge port, third removable means for covering the rear discharge port to selectively block gases from flowing through said rear discharge port, a second filter for filtering gases received from the vicinity of the front of the eye-level oven, means for securing said second filter within the front intake port of the intake chamber, a vertical panel positioned inside the hood defining the boundary between the isolated chamber and the intake and exhaust chambers, said isolated chamber being positioned over the oven exhaust vents to receive gases from the oven, said hood having isolated discharge port for transmitting gases out of the isolated chamber, a switch means for controlling the flow of electric current to the fan or blower, means for mounting said switch on the front surface of the hood adjacent the intake hole, hinges attached to the hood, said hinges forming a pivot axis adjacent the line of intersection between the top and front surfaces of the hood, a hinged cover pivotally supported by the hinges for selectively blocking said front intake port and for covering the front wall of the third chamber of the hood, said hinged cover having a hole to allow access to the switch means, a curved plate attached to the hinged cover for supporting said hinged cover in an open position to allow gases to pass through the front intake port, an indent impressed in the curved plate for supporting said plate, and a catch on the front surface of said hood for engaging and supporting the indent.

* * * * *